US006698709B2

(12) United States Patent
Ward et al.

(10) Patent No.: US 6,698,709 B2
(45) Date of Patent: Mar. 2, 2004

(54) CONCRETE FORMING PANEL WITH LIGHTWEIGHT FRAME

(75) Inventors: Philip T. Ward, Leawood, KS (US); Roman Brewka, St. Joseph, MO (US)

(73) Assignee: Western Forms, Inc., Kansas City, MO (US)

( * ) Notice: Subject to any disclaimer, the term of this patent is extended or adjusted under 35 U.S.C. 154(b) by 161 days.

(21) Appl. No.: 09/791,402

(22) Filed: Feb. 23, 2001

(65) Prior Publication Data

US 2002/0117598 A1 Aug. 29, 2002

(51) Int. Cl.[7] ..... E04G 17/04
(52) U.S. Cl. ..... 249/196; 249/47
(58) Field of Search ..... 249/44, 45, 46, 249/47, 191, 192, 193, 194, 196; 428/588, 589, 617, 636

(56) References Cited

U.S. PATENT DOCUMENTS

| | | | | |
|---|---|---|---|---|
| 3,447,771 A | * | 6/1969 | Trimmer | 249/192 |
| 3,862,737 A | * | 1/1975 | Fuston, Jr. | 249/196 |
| 4,194,717 A | * | 3/1980 | Easton et al. | 249/196 |
| 4,708,315 A | | 11/1987 | Carlson et al. | |
| 4,744,541 A | | 5/1988 | Carlson et al. | |
| 4,958,800 A | | 9/1990 | Carlson | |
| 4,976,401 A | | 12/1990 | Carlson | |
| 4,978,099 A | | 12/1990 | Carlson | |
| 5,058,855 A | | 10/1991 | Ward | |
| 5,080,321 A | | 1/1992 | Carlson | |
| 5,174,909 A | | 12/1992 | Ward | |
| 5,184,439 A | | 2/1993 | Ward | |
| 5,288,051 A | | 2/1994 | Ward | |
| 5,759,429 A | * | 6/1998 | Trimmer et al. | 249/196 |
| 5,965,053 A | | 10/1999 | Carlson | |

FOREIGN PATENT DOCUMENTS

DE 2747067 * 5/1979

OTHER PUBLICATIONS

Brochure: The World's Leading Innovator in Aluminum Forming Systems (Western Forms, Inc. 1993) (1 page and 1 card enclosure in the back) (6 pages printed on front and back including cover).
Brochure: A New Generation in Aluminum Forming Systems (Western Forms, Inc., 1998) (6 pages printed on front and back including cover).
Brochure: Concrete Forming Accessories, 2nd ed. (Western Forms, Inc. (before 1999)) (49 printed pages not including front/back cover, divider tabs and printing on inside of covers).
Western Forms, Inc. Catalog titled "World's Leading Innovator in Aluminum Forming Systems" copyright 1999, all pages.

* cited by examiner

*Primary Examiner*—Michael Safavi
(74) *Attorney, Agent, or Firm*—Hovey Williams LLP

(57) ABSTRACT

A concrete forming panel with lightweight siderail includes a face plate and a frame, the frame including at least one siderail and a bushing plate coupled thereto, the bushing plate having thereon a wear member of a material having greater hardness than the bushing plate. The wear member is positioned adjacent an opening in the bushing plate, the hole being in registry with a corresponding hole in the siderail, whereby fasteners passing through the hole and opening to couple the forming panel to other structual members in a concrete forming system, such as another forming panel, will engage the wear member. The use of a wear member permits the use of lighter weight siderails and bushing plates.

9 Claims, 4 Drawing Sheets

CONCRETE FORMING PANEL WITH LIGHTWEIGHT FRAME

BACKGROUND OF THE INVENTION

1. Field of the Invention

The present invention broadly concerns a panel used for forming concrete which is of reduced weight and thus easier to use by providing a selectively reinforced lightweight sidewall. More particularly, it is concerned with a concrete forming panel which employs a lightweight metal such as aluminum as the primary frame material and which incorporates a steel wear and reinforcement member at areas of selected wear.

2. Description of the Prior Art

Concrete is typically poured into forms which permit the concrete to set in a desired shape or configuration. The forms are then removed, leaving the solidified concrete to form a structural member, such as a wall or the like. In small construction jobs, plywood may be used as the form and supported by wood studs until the concrete hardens into the desired shape. Such forming practices are well known but not particularly economical when a builder must repeatedly form similar walls during a series of construction projects.

For this reason, reusable concrete forming panels of metal have been developed which may be positioned and held together to provide a concrete forming wall with a central cavity. Such known forming panels include those shown in, for example, U.S. Pat. Nos. 4,708,315, 4,958,800, 5,058,855, 5,184,439, and 5,965,053, the disclosures of which are incorporated herein by reference. Aluminum forming panel systems provide faster construction set up than standard steel and plywood systems, are lighter in weight, and typically leave a smooth wall surface which is better looking than other construction form systems. Aluminum forming panel systems typically employ pin and wedge systems that are simple to use and easy to handle, and tie bars which connect opposed wall forming panels to receive concrete therebetween. In addition, steel plates may be riveted to the sides of the forming panels to provide bushings for receipt of hardened objects such as pins therethrough. Because of the wear of steel pins and wedges against aluminum surfaces and the use of tie bars to connect opposed panels, the steel bushings have been required to providing the existing aluminum forming panels with a satisfactory useful life.

While rugged aluminum concrete forming panels have been successful in use, they nonetheless require substantial material in order to withstand the loads and wear imposed by use at a construction site. This, and the use of steel plates as bushings increases the overall weight of the forms which may be significant to the user when multiple forms are in use. There has thus developed a need for a forming panel useful in many environments which includes less steel and is lighter in weight than past aluminum forming panels.

SUMMARY OF THE INVENTION

These objects have largely been met by the concrete forming panel with lightweight sidewall in accordance with the present invention. That is to say, the concrete forming panel hereof is strong, rugged, and able to withstand wear imposed by the contact of the frame with steel pins and wedges by a wear element of a material having a greater hardness than the bushing on which it is received, thereby permitting overall reduction in weight and providing selective reinforcement of wear-prone areas of the bushing and frame.

In greater detail, the invention hereof includes a face sheet secured, preferably by welding, to a surrounding frame having at least one side rail and preferably opposed end rails and side rails. The side rail may be provided as a relatively thin member such as a sheet of formed or extruded aluminum. Lightweight reinforcement bushings, typically of aluminum, are either spaced or provided continuously along the side rails or end rails. The aluminum reinforcement bushings include a hardened wear element, such as steel reinforcing rods extending longitudinally along the rails which are preferably attached to the bushing leaving a portion of the wear element exposed. The wear element is preferably positioned adjacent an opening through the aluminum reinforcement bushing, the opening being in registry with a hole in the rail in order to provide wear surfaces. Pins placed through these holes thus bear, at least partially, against the steel wear elements to inhibit expansion of the opening. Further, the steel wear elements, such as steel washers or reinforcing rods, are preferably embedded in the aluminum reinforcement bushings in a manner to present an exposed portion against which the head of a connecting pin or its securing wedge may bear when the form is in use. The reinforcing rod may be provided as a single longitudinally extending rod, or more preferably two parallel longitudinally extending rods positioned diametrically opposite the hole in the aluminum bushing, either on the same face of the bushing or on opposite faces. The wear elements also have a higher modulus of elasticity than the aluminum rails and bushings, and thus provide increased strength for the frame.

The end rail and side rail may be cast, forged or machined of material, typically aluminum, and is significantly thinner in cross section than that previously employed in concrete forming panels, or may be extruded having hollow chambers to reduce the amount of material in any cross-sectional area relative to prior aluminum forming panel frames. The side rail preferably has a face sheet edge welded to the face sheet of the forming panel and an exposed edge provided with a rounded shoulder. Preferably, the side rail is provided with a thinned central waist with thicker portions adjacent the edges, as by concentrating the added material along the edges produces a more efficient means of addressing stress concentrations in the forming panel.

As a result of the present invention, a lightweight forming panel may be provided which nonetheless is rugged and maintains its shape in use. The steel reinforcing rods are positioned in critical locations to reduce the amount of material required in constructing the forming panel and reduce wear during use. The positioning of the steel reinforcing rods adjacent the holes in the side rail inhibit expansion of the hole due to the hardness of the steel pins and wedges wearing against the aluminum and the resulting misalignment of adjacent panels which yields uneven poured concrete surfaces. Additionally, the steel reinforcing rods resist cocking of the pins relative to the desired insertion/extraction axis, which makes the steel pins dig into the aluminum surfaces and increases the difficulty of removal. The steel reinforcing rods give a hardened surface for the wedge to bear against, and add strength to resist deformation of the frame by impact or other loads applied thereto. Because of the thinning of the side rail itself, the face sheet has a smaller distance from its edge to the weld, resulting in a smaller cantelever arm from the weld to the edge of the face sheet. This helps in resisting "peeling" of the face sheet from the side rail or end rail. The aluminum bushing is preferably shaped to provide a cove especially configured to provide for this first weld bead between the side rail and the face sheet on the inside corner formed therebetween, and thereby facilitate this reduction of the moment arm.

These and other objects of the present invention will be readily apparent to those skilled in the art with reference to the description and drawings which follow.

DESCRIPTION OF THE PREFERRED EMBODIMENT

Figure 1:
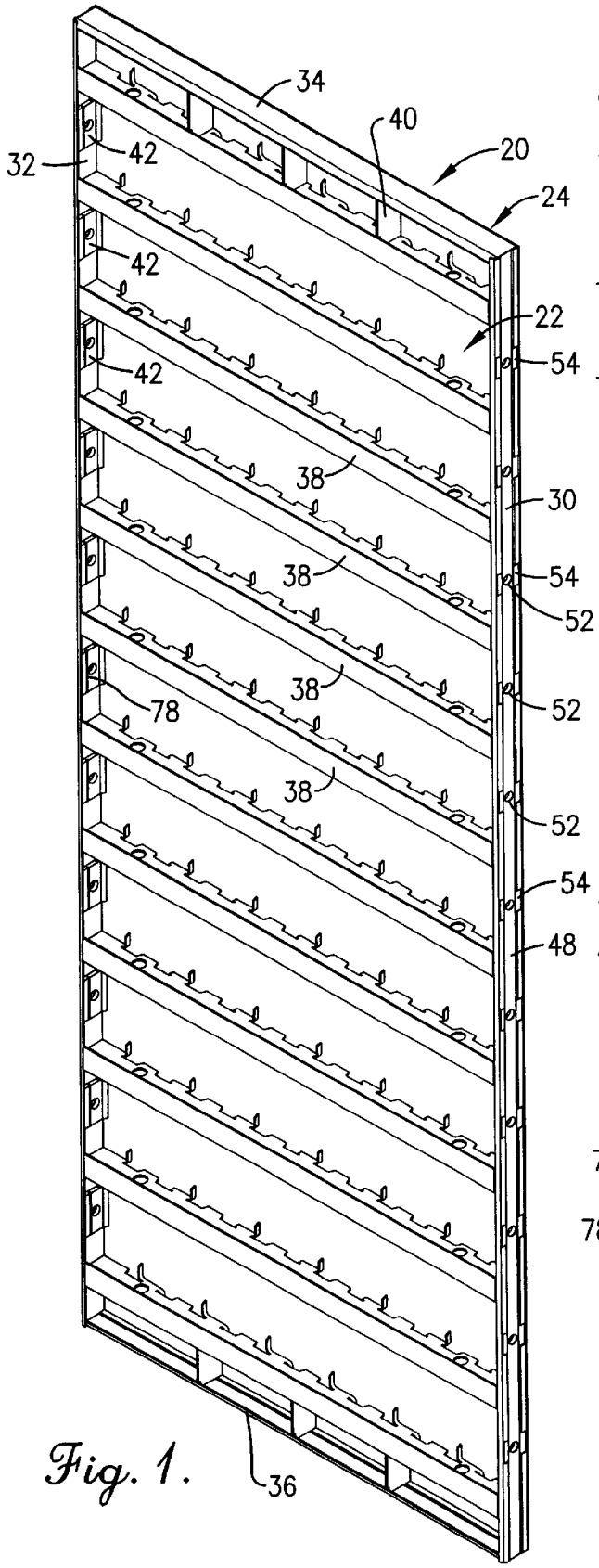
FIG. 1 is a rear perspective view of a concrete forming panel with a lightweight frame in accordance with the present invention, showing the use of separate aluminum bushings positioned in longitudinally spaced relationship along the frame side rail.

Referring now to the drawing, a concrete forming panel 20 in accordance with the present invention broadly includes a face plate 22 and a frame 24. The face plate 22 is of a thin, lightweight sheet of material, preferably aluminum (to include an alloy thereof), typically about 0.090 to 0.125 inches in thickness. The face plate 22 has a forming face 26 which is oriented toward the poured cementations material such as concrete to present a surface to be hardened thereagainst, and a back face 28 which lies adjacent the frame 24. While the face plate 22 is often smooth and flat, it may be embossed to provide a textured pattern such as simulated brickwork as desired so that concrete hardening against the forming face 26 has a desired textured appearance. The face plate 22 and frame 24 may be in a variety of shapes such as round, oval, or any other, but in the majority of wall forming applications, the forming panel 20 will be rectangular as shown in FIG. 1.

In this configuration, the frame 24 typically includes a pair of elongated, opposed, parallel spaced-apart side rails 30 and 32, and a pair of elongated, opposed, parallel spaced-apart end rails 34 and 36 oriented perpendicular to the side rails 30 and 32. The frame 24 may also include cross-reinforcements 38 which are uniquely configured for lightness of weight and strength, end braces 40, and corner gussets or other attachments, which, like the side rails and end rails, are preferably of a lightweight material such as aluminum. Each side rail may also be provided with at least one bushing plate 42.

Figure 2:
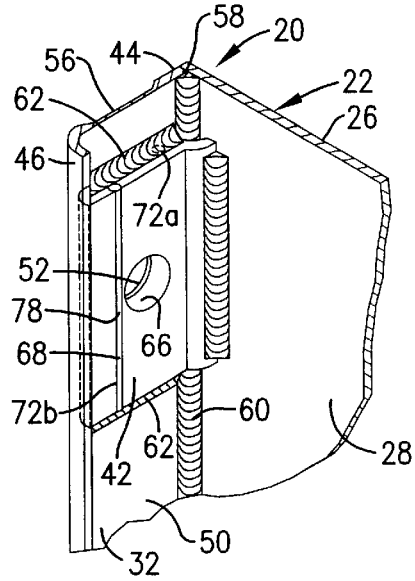
FIG. 2 is an enlarged, fragmentary perspective view of a portion of the forming panel of FIG. 1, showing an aluminum bushing welded in place along the side rail and one of the embedded steel reinforcing rods adjacent the hole through the bushing and the side rail.
Figure 3:
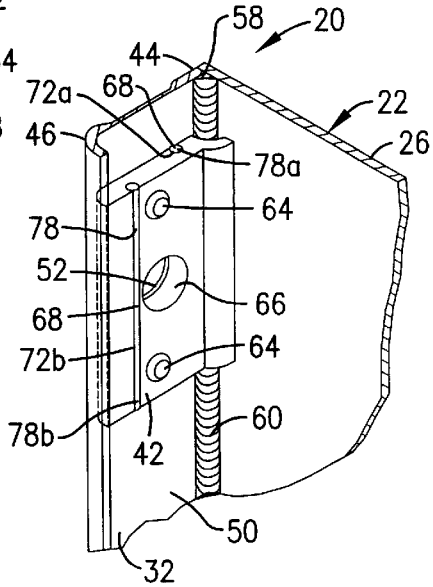
FIG. 3 is an enlarged, fragmentary perspective view similar to FIG. 2, but wherein the aluminum bushing of FIG. 2 is riveted to the side rail.

In greater detail, the side rails have a face plate edge 44 adjacent the face plate 22, an exposed edge 46 relatively remote from the face plate 22, an outer surface 48 and an inner surface 50 which typically faces the opposite side rail. At least one, and preferably a plurality of holes 52 pass through the side rails 30 and 32 at spaced intervals. The outer surface 48 includes passage surfaces 54 for engaging tie bars which join opposite forming panels 20 together and thereby provide a channel for the receipt of concrete therebetween. As seen in FIGS. 2 through 8, the exposed edge 46 and the face plate edge 44 are have a greater thickness than the thickness of the midsection 56 of the side rail located therebetween. The provision of greater thickness and thus more material at the face plate edge 44 and exposed edge 46 provides improved strength at the areas of greater stress concentration, while the midsection 56 requires less material because it encounters fewer impacts and requires less strength, thereby reducing overall weight and maintaining the desired rigidity of the forming panel 20. If desired, the end rails 34 and 36 may be similarly configured with reduced thickness at the midsection relative to the edges. The face plate 22 and the side rails 30 and 32 abut at comers of the rectangular frame as shown in FIGS. 2 and 3 so that the face plate 22 extends laterally beyond the inner surface 50 of the side rails 30 and 32, and form a junction 58. A welding bead 60 or alternatively a fastener or other attachment member or an adhesive or other bonding connects the face plate 20 to the side rails at the junction 58. The cross-reinforcement 38 may also be welded to the face plate 20. The outer surface 48 of the side rail at the exposed edge 46 is preferably arcuate and convex, while the inner surface 50 at the exposed edge 46 is preferably arcuate and concave, which helps to strengthen the side rail and avoid a sharp exposed edge 46 for handling purposes and reducing the likelihood of damage to the forming panel 20.

The bushing plate 42 is preferably primarily of aluminum or other lightweight material, and attached by welds 62 as shown in FIG. 2, or by fasteners such as rivets 64 as shown in FIG. 3, to the inner surface 50 of the side rails. The bushing plate 42 includes an opening 66 which is preferably of the same size and configuration as the hole 52, and positioned in registry therewith. The bushing plate 42 has a wear element 68 coupled thereto which is of a second material such as steel which is harder than the bushing plate 42. Because aluminum is much lighter than steel (about 0.098 to about 0.101 lbs. per cubic inch for aluminum versus about 0.284 to about 0.286 lbs. per cubic inch for steel), the forming panel 20 may be made considerably lighter by using aluminum or its alloys for the bushing plate 42. However, aluminum has a much lower hardness than steel (about 30 on the Brinnell hardness scale (Bhn) for cold rolled ASTM 6061 aluminum versus a Bhn number of about 111 for hot rolled SAE 1020 steel and a Bhn of 179 for hardened, tempered SAE 1020 steel), and thus provision of a wear element 68 adjacent the opening 66 serves to resist damage to the bushing plate 42 and inhibit alteration of the configuration of the opening 66 and the hole 52 in the siderail. The use of steel for the wear element also provides increased strength to the bushing and the side rail to which it is attached. For example, ASTM 6061 aluminum has a tensile strength of about 20,000 to 40,000 psi and a yield strength of about 8,000 psi, whereas hot rolled SAE 1020 steel has a tensile strength of about 55,000 psi and a yield strength of about 30,000 psi and hardened, tempered SAE 1020 steel has a tensile strength of about 90,000 psi and a yield strength of about 60,000 psi. A particularly preferred steel for use as the wear element is an ASTM-228-93 steel wire having a tensile strength of about 254,000 psi to about 259,000 psi and a Bhn of about 518 to 529. The wear element 68 may be applied directly on the bushing plate, or more preferably is received within a recess 70. A portion of the wear element 68 is preferably exposed along one or both of the inner surface 50 and the periphery of the opening 66, although it would be possible to embed the wear element so that the wear on the opening on opening 66 or inner surface 50 would quickly expose the wear element 68 to a pin, wedge or the like.

As shown in FIGS. 2 through 14 of the drawings, the recess 70 is provided adjacent the opening 66 and is preferably provided as an elongated groove 72. Most preferably, two parallel, spaced-apart grooves 72*a* and 72*b* are provided in the bushing plate 42, one of the grooves 72*a* being open along a first side 74 of the bushing plate 42 oriented toward the inner surface 50 of the respective side rail and the other of the grooves 72*b* being open along a second side 76 oriented away from the inner surface 50 of the respective side rail. Each of the longitudinally extending grooves 72*a* and 72*b* has, as a wear element 68, an elongated rod 78 received therein. Thus, reinforcing rod 78*a* is received in groove 72*a* and reinforcing rod 78*b* is received in groove 72*b*. In each instance, at least a part of the reinforcing rod 78*a* and 78*b* is preferably exposed by the groove exteriorly of the bushing plate 42, although it may be appreciated that the reinforcing rods could be located in a tubular recess so that after wear on a thin skin of aluminum over the and exposed by wear of the surrounding portions of the bushing plate 42.

The bushing plate 42 is positioned to be located along the inner surface 50 of the side rail, and thus advantageously includes a rounded, convex margin 80 for complemental fitting with the concave configuration of the inner surface 50 at the exposed edge, and a cove 82 positioned on the bushing plate 42 to be located opposite the junction 58 between one of the side rails 30, 32 and the face plate 22. The cove 82 is preferably slightly rounded and convex, whereby the bead 60 is received within the cove 82. This is particularly advantageous in comparison to existing forms using thicker—⅜ inch at the junction—aluminum side rails, as the bead 60 is located more remote from the edge of the face plate, whereas by using a relatively thinner—⅛ inch thick at the face plate edge 44 adjacent the face plate 22—side rail 30, 32, the bending moment between the weld 60 and the edge 84 of the face plate 22 is substantially reduced. The use of the cove 82 permits the bead 60 to be continuous along the junction 58, and thereafter the weld beads 62 or fasteners 64 used to couple the bushing plate 42 to the respective side rail 30, 32. As may be seen in FIG. 1, the bushing plates 42 are provided at spaced intervals along the side rails corresponding to the location of the holes 52.

One method of making the bushing plates 42 is to fabricate the bushing plates by extrusion or by casting to the generally desired shape. Any desired recesses 70, such as grooves 72, are formed during fabrication of the bushing plate 42 or cut thereafter. After the wear elements 68, such as reinforcing rods 78, are placed into their recesses 70, such as by sliding the reinforcing rods 78 through the grooves 72, one or more openings 66 are bored through the bushing plate 72 adjacent the wear elements. The boring of the opening 66 causes slight movement of the lightweight and relatively softer material adjacent the grooves 72, which in turn engages the wear element 68 and holds it in place. Thus, while further bonding through adhesives or spot welding may be used to hold the wear element in place, the boring of the opening 66 through the softer aluminum material immediately adjacent the wear element 68 is typically sufficient to hold the reinforcing rod in place in its groove. The bushing plate 42 is then installed on the inside surface 50 of the side rails 30, 32 at the desired locations therealong by welding or fastners as illustrated respectively in FIGS. 2 and 3.

Figure 4:
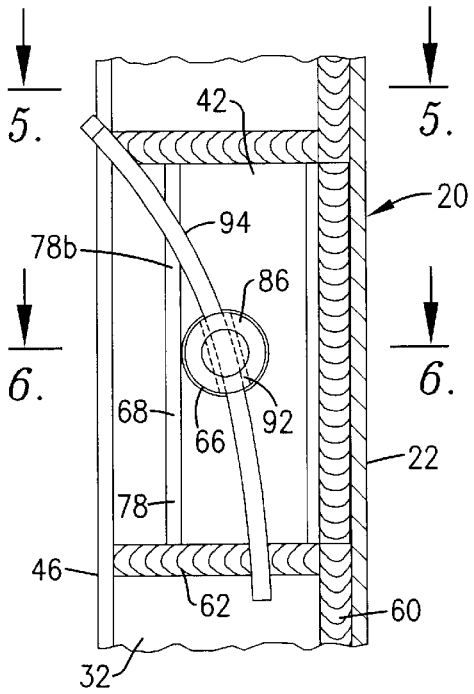
FIG. 4 is an enlarged, fragmentary side elevational view of the frame taken through a vertical section of the face sheet of the forming panel of FIG. 1, showing a pin and securing wedge in place to hold together two forming panels in side-by-side relationship, coupled together, and with the aluminum bushing welded in place as shown in FIG. 2.
Figure 5:
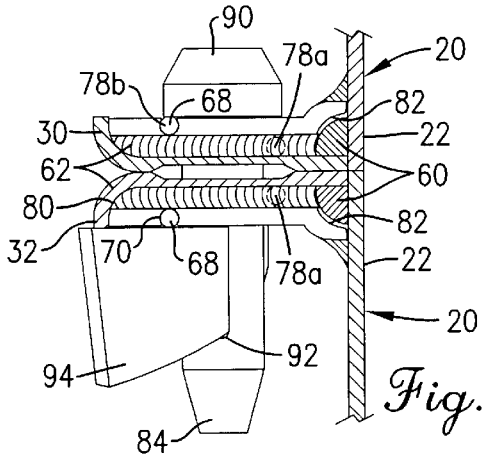
FIG. 5 is an enlarged horizontal cross-sectional view taken along line 5—5 of FIG. 6 showing the wedge through the pin bearing against one of the steel reinforcing rods and the cove of the bushings receiving the weld beads connecting the face plates to their respective siderails.
Figure 6:
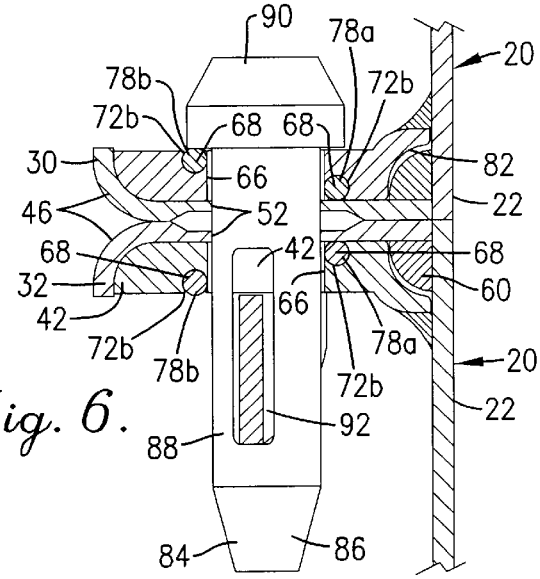
FIG. 6 is an enlarged horizontal cross-sectional view taken along line 6—6 of FIG. 4, showing the head of the pin bearing on one of the steel reinforcing rods.
Figure 7:
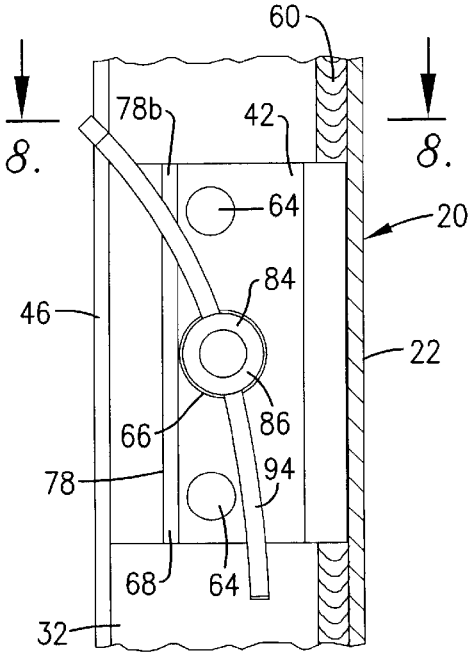
FIG. 7 is an enlarged, fragmentary side elevational view taken through a vertical section of a portion of two of the forming panels of FIG. 1 positioned in side-by-side relationship, coupled together, and similar to FIG. 4 wherein the aluminum bushing is riveted in place.
Figure 8:
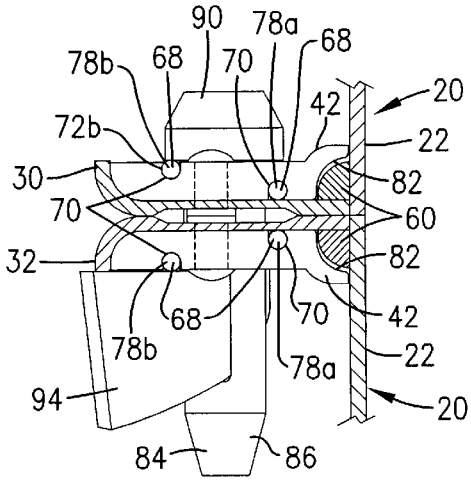
FIG. 8 is an enlarged horizontal cross-sectional view taken through line 8—8 of FIG. 7 showing the wedge through the pin bearing against one of the steel reinforcing rods and the cove of the bushing receiving the weld beads connecting the face plates to their respective siderails.

FIGS. 4 through 8 illustrate the forming panel 20 hereof in use. One typical application is the placement of two forming panels 20 in side-by-side relationship with the holes 52 through their adjacent side rails 30 and 32 in alignment. A coupler pin 84 is then inserted through the holes 52 and openings 66, the coupler pin including a tapered end 86, a shank 88 and an enlarged head 90. The shank 88 includes a slot 92 for receiving a securing wedge 94 partially therethrough. The pin 84 and wedge 94 are most commonly provided of steel of a sufficient hardness to gouge or erode the aluminum of the side rails 30 and 32 and bushing plate 42 adjacent the respective holes and openings. The wedge 94 may be curved as seen in FIGS. 4 and 7 but preferably provided with at least one flat edge which engages one of the steel reinforcing rods 78*b* which protects the adjacent aluminum surfaces of the bushing plate 42 and the siderail 32. The head 90 of the pin engages the reinforcing rod 78*b* on the bushing plate 42 attached to the adjacent side rail 30 of the other forming panel 20, whereby the head of the coupler pin 84 is inhibited from wearing against that bushing plate 92. The reinforcing rods 72*a* are positioned to bear against the shank 88 of the pin 84 should it become misaligned or cocked. It is advantageous to provide the reinforcing rods 78*a* and 78*b* in diametrically spaced relationship across the opening 66 to inhibit the opening from being enlarged in only one direction.

Figure 9:
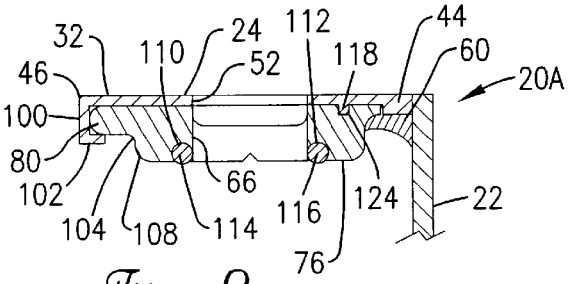
FIG. 9 is a cross-sectional view of a second embodiment of the lightweight frame showing the side rail of the forming panel hereof, the bushing having a recessed rim and the side rail having a retaining leg at the exposed edge.
Figure 10:
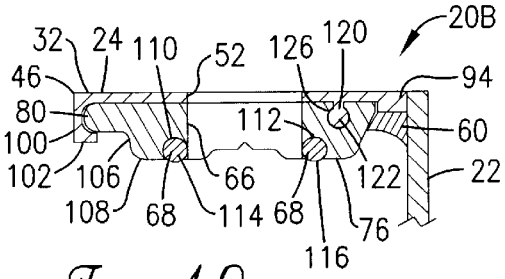
FIG. 10 is a cross-sectional view of a third embodiment of the lightweight frame showing the side rail of the forming panel hereof which includes a retaining leg at the exposed edge of the side rail; a lip on the inside surface of the side rail and a complemental groove in the bushing.

FIG. 9 illustrates a second embodiment of the forming panel 20A, and FIG. 10 illustrates a third embodiment 20B, wherein the side rails have a flange 100 at the exposed end 46 which is oriented substantially parallel to the face plate 22 and a turn 102 oriented 90 degrees thereto toward the face plate 22 to enclose and protect the margin 80 of the bushing plate. The bushing plate 104 of FIG. 9 and the bushing plate 106 of FIG. 10 are substantially similar, wherein each is provided with a thicker central region 108 through which opening 66 passes. Each of the bushing plates 104 and 106 is of aluminum or other relatively softer material and include recesses provided as longitudinally extending, parallel grooves 110, 112 in the second side 76 of the bushing plates and diametrically opposed across the openings 66. The grooves 110 and 112 receive therein wear elements provided as reinforcing rods 114 and 116 therein which are preferably exposed inwardly to the opening 66 and also to the second side 76 of the bushing plate, the reinforcing rods being provided of steel or other similar relatively harder material than the bushing plates and side rails. Each of the side rails are provided with a longitudinally extending, inwardly projecting lip which is configured complemental to a slot in the bushing plate. In the forming panel 20A shown in FIG. 9, the lip 118 is a rectangular projection which is received in a corresponding substantially rectangular slot 124 in the bushing plate 104. In the forming panel 20B shown in FIG. 10, the lip 120 includes a narrowed neck and an enlarged rounded knuckle 122 which is received in a rounded slot 126 and serves to hold and retain the lip 120 therein both in a direction toward and away from the face plate 22 and also in a direction toward and away from the side rail. The bushing plates 104 and 106 are configured to permit the bead 60 to hold both the side rails and the bushing plates to the face plate 22.

Figure 11:
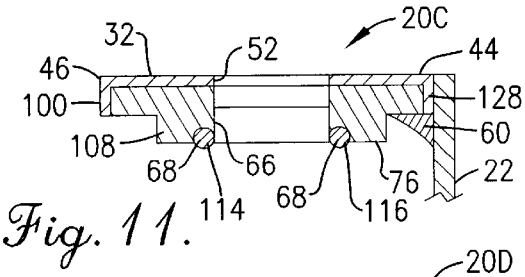
FIG. 11 is a cross-sectional view of a fourth embodiment of the lightweight frame showing the side rail of the forming panel hereof, the bushing having a thickened central waist portion and the side rail including flanges at the exposed edge and the face sheet edge.

A further embodiment of the forming panel 20C is shown in FIG. 11 which is similar to that shown in FIGS. 9 and 10 in that it includes a thickened central region 108 in surrounding relationship to the opening 66 and includes grooves 112 and 112 receiving reinforcing rods 114 and 116, and includes flange 100 but without turn 102. The face plate edge 128 is provided as a flange extending parallel to the face plate 22 and in adjacency therewith, the face plate edge 128 thus being a mirror image to the flange 100.

Figure 12:
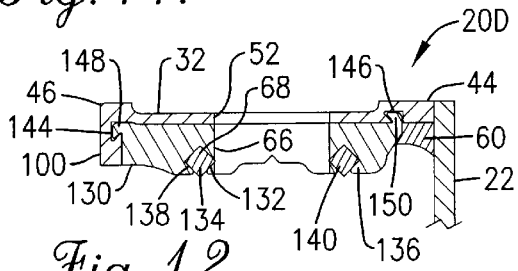
FIG. 12 is a cross-sectional view of a fifth embodiment of the lightweight frame showing the side rail of the forming panel hereof, wherein the siderail has grooves which mate with complemental dovetails on the bushing, and the steel reinforcing rods are rectangular in cross section.
Figure 13:
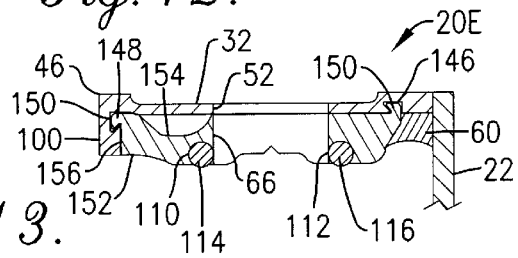
FIG. 13 is a cross-sectional view of a sixth embodiment of the lightweight frame showing the side rail of the forming panel hereof similar to FIG. 12 but wherein the bushing includes a longitudinally extending recess adjacent and facing the inside surface of the siderail.

FIGS. 12 and 13 illustrate two further embodiments of the forming panel hereof. FIG. 12 shows forming panel 20D which has siderails 32 including flange 100 and bushing plate 130. Bushing plate 130 includes a thickened central region 132 surrounding opening 66 and includes elongated longitudinally extending parallel and diametrically opposed rectangularly shaped recesses or grooves 134 and 136 which receive therein complementally configured rectangular in cross-section reinforcing rods 138 and 140. The reinforcing rods 138 and 140 are preferably oriented to present one corner oriented toward and exposed into the opening 66 and another corner oriented toward and exposed in the direction of the second side 76. A longitudinally extending notch 142 may be provided along the central region 132 between the reinforcing rods 138 and 140. The siderail 32 is modified to include a dovetailed slot 144 on the inner surface adjacent the exposed edge 46 and another dovetailed slot 146 on the inner surface proximate the face plate edge 44, the slots 144 and 146 receiving respective complementally shaped lips 148 and 150 on the bushing plate 130 which project into and are held by the slots 144 and 146. The dovetail configuration of the lips and slots helps to locate and retain the bushing plate relative to the siderail during fabrication and in use. FIG. 13 illustrates a similar embodiment of the forming panel 20E hereof, but wherein the bushing plate 152 is further lightened by the provision of a lightening trough 154 on the first side 74 positioned between the opening 66 and the margin 156.

Figure 14:
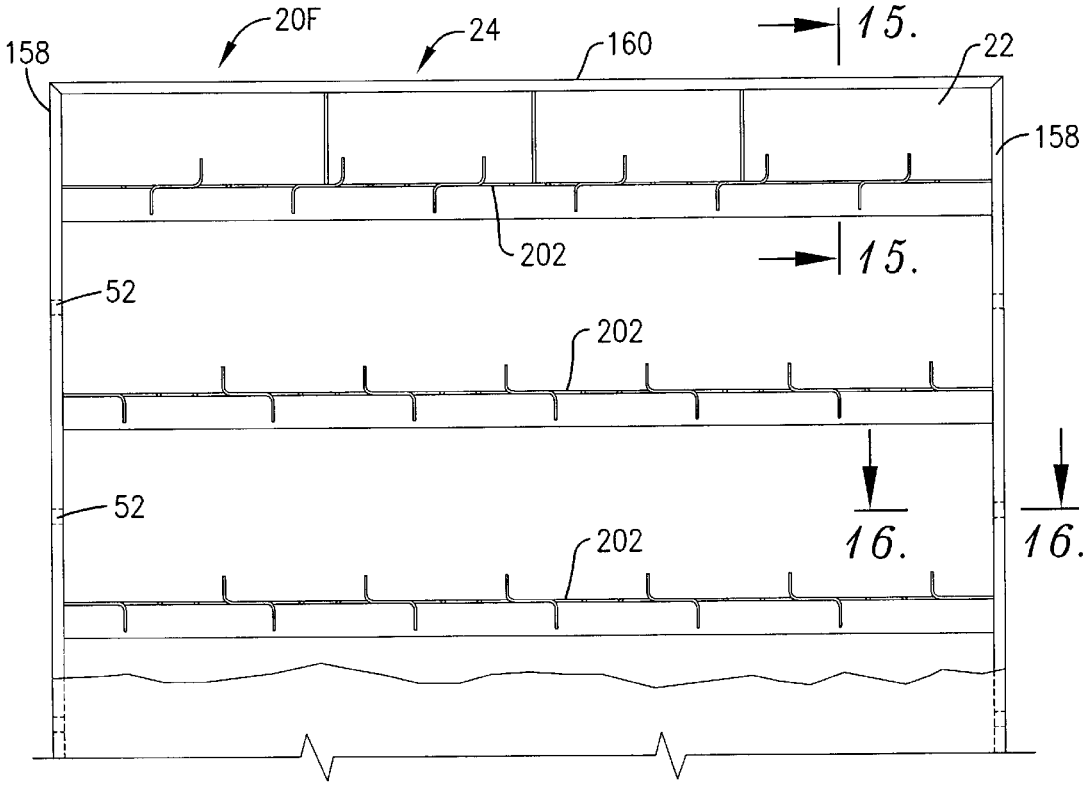
FIG. 14 is a fragmentary front elevational view of a seventh embodiment of the forming panel with lightweight frame hereof, showing a part of the face plate broken away to show the use of L-shaped cross-reinforcements and extruded end and side rails with hollow channels.
Figure 16:
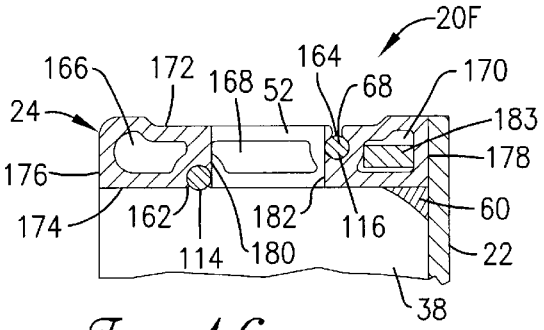
FIG. 16 is a fragmentary horizontal cross-sectional view taken through line 16—16 of FIG. 14, showing the configuration of the side rail with hollow channels and the wear elements.
Figure 15:
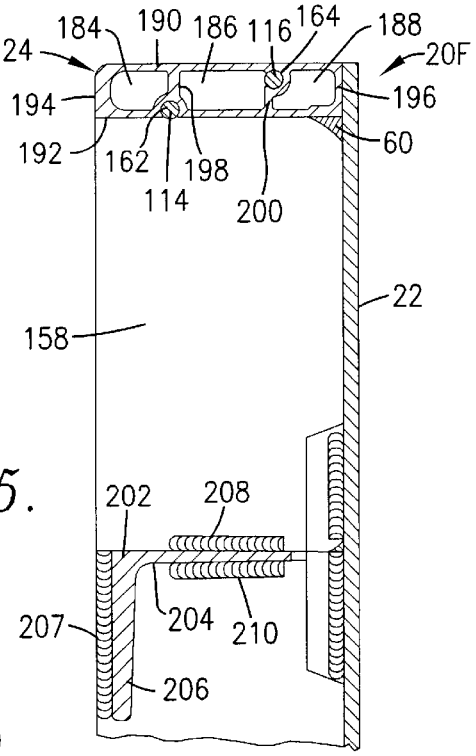
FIG. 15 is a fragmentary vertical cross-sectional view taken through line 15—15 of FIG. 14, showing the use of the wear members as reinforcements in the end rails.

In the embodiment of the forming panel 20F shown in FIGS. 14–16, the frame 24 includes hollow, elongated, tubular side rails 158 and hollow, elongated, tubular end rails 160 extruded from aluminum or other lightweight material. Both the side rails 158 and the end rails 160 include elongated grooves 162 and 164 therein as shown in FIGS. 15 and 16. As may be observed from FIG. 16, the axis of hole 52 in side rail 158 extends transversely trough side rail 158. Grooves 162 and 164 are offset from one another along the axis of hole 52. The grooves 162 and 164 provide elongated, longitudinally extending, diametrically opposed and substantially parallel recesses into which may be inserted steel reinforcing rods 114 and 116. The steel reinforcing rods serve both as wear elements and strengthening elements. The side rail 158 includes at least one hollow chamber shown as elongated chambers 166, 168 and 170 formed and bounded by sidewalls 172 and 174, endwalls 176 178, and central walls 180 and 182. A steel reinforcing member 183 such as an elongated bar may be received in one or more of the chambers 166, 168 or 170 as shown in FIG. 16. Pins 80 received in hole 52 and wedges driven through the slots in the shanks 88 may hear against the reinforcing rods 114 and 116 and thus reduce wear to the aluminum side rail 158. The end rails 160 are similarly configured to include elongated chambers 184, 186 and 188, formed and bounded by sidewalls 190 and 192, endwalls 194 and 196, and central walls 198 and 200. The walls serve to provide sufficient stiffness and rigidity to the side rail and end rail not with stand in the lightening of the side rails 158 and end rails by the hollow chambers. In the embodiment of the forming panel 20F, the cross-reinforcements 202 are similar to cross-reinforcements 38 but are provided as L-shaped beams having a rearwardly extending leg 204 and a second leg 206 oriented generally perpendicular thereto and generally parallel to the face plate 22. The ends of the cross-reinforcements 38 and 202 may be welded to the side rails by welds 204 and also to the face plate 22 for improved structural integrity by welds 207, 208 and/or 210.

Figure 17:
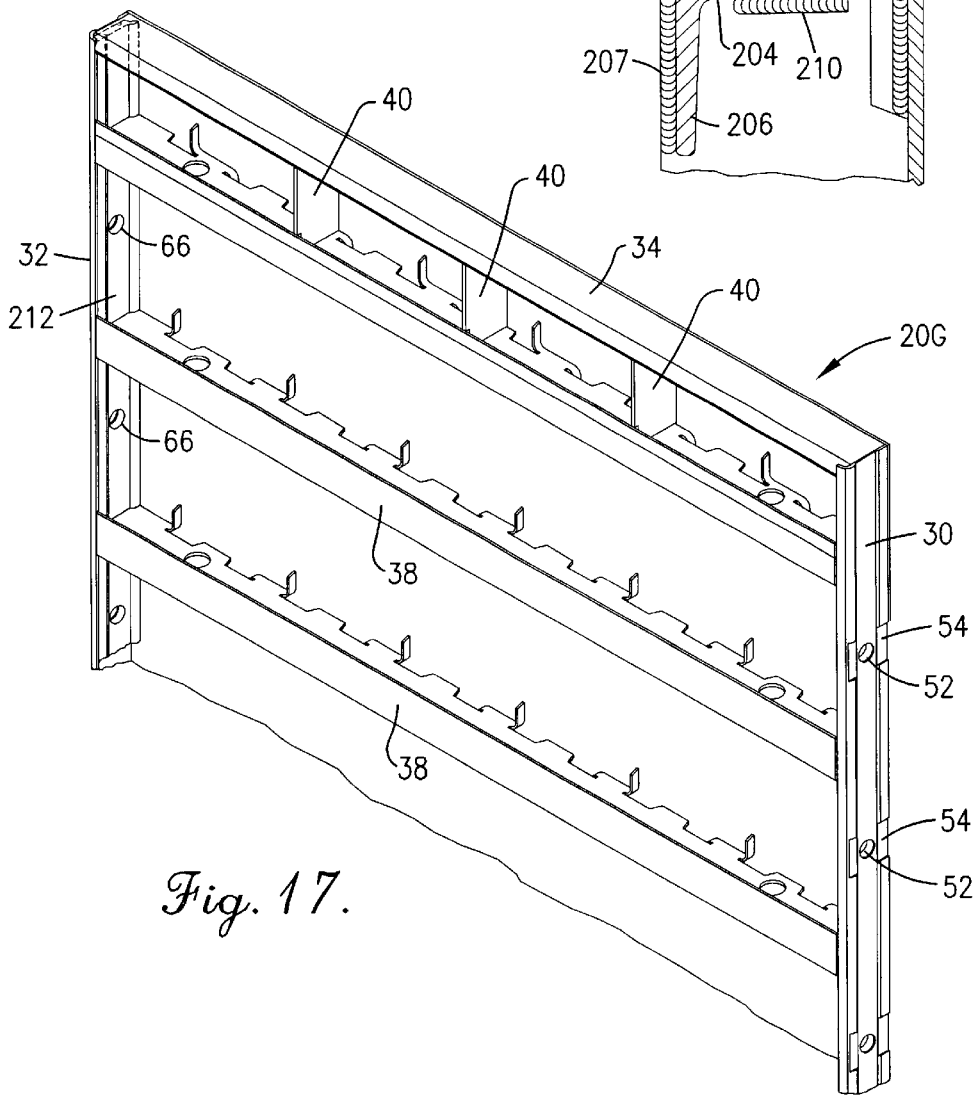
FIG. 17 is a fragmentary perspective view of a further embodiment of the forming panel hereof, wherein the aluminum bushing is continuous rather than provided in a plurality of discrete sections and extends longitudinally along the inner surface of the side rail.

FIG. 17 shows a forming panel 20G having frame 24 and face plate 22 as shown in FIG. 1, but wherein the bushing plate 212, configured as shown in FIGS. 2 through 8, is continuous instead of provided as a plurality of spaced, discrete elements. The provision of a continuous bushing plate 212 provides additional strength and rigidity to the side rails 32 and 34, but also has the benefit of enabling additional holes to be drilled through the sidewall and openings in registry with the holes drilled though the bushing plate 212 in the event that excessive wear develops in a location.

The holes and openings may be drilled through the relatively soft aluminum without the necessity of drilling through the harder steel wear elements by simply drilling between the reinforcing rods.

It may be appreciated that each of the embodiments shown enlarged in FIGS. 9 through 13 may be provided not only as shown with regard to the siderail with discrete bushing plates as shown in FIGS. 1 through 8 but also the continuous bushing of FIG. 17. The side rails as illustrated could also be provided as the end rails in the forming panels. It is to be appreciated that all though each of the foregoing embodiments is shown in reference to a substantially rectangular forming panel in FIGS. 1 and 17, each could be provided with a continuous single side rail such as a forming panel having a circular, oval or similar shape.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the literal scope of the invention as set out in the following claims.

What is claimed is:

1. A concrete forming panel comprising:

a face plate;

a frame coupled to said face plate and including at least one rail, said rail having an exposed edge and a face plate edge proximate the face plate, an inner surface and an outer surface and at least one hole extending therethrough and adapted to receive a coupling pin, said hole having a inner circumscribing periphery, said rail being of a first material; and a wear element of a second material having a hardness greater than that of said first material and coupled to said rail with a majority of the wear element recessed below the inner surface of the rail and substantially positioned outboard of the periphery of the hole, at least a part of the wear element being exposed along the inner surface of the rail and said periphery of the hole in a pin-engaging position, said first material being selected from the group consisting of aluminum and alloys thereof and said second material being steel, said wear element being elongated and positioned tangential to said hole within a recess, said rail being elongated and said recess being provided in said rail as a longitudinally extending groove and said wear element being a longitudinally extending reinforcing rod.

2. A concrete forming panel comprising:

a face plate; and a frame including at least one rail, said rail including at least one longitudinally extending hollow chamber and having a transversely extending hole through the rail adapted for receiving a coupling pin therethrough, the rail being of a first material and further including a wear element of a second, relatively harder material coupled to said rail proximate to said hole whereby a portion of said wear element is exposed in pin engaging relationship to said hole, said rail including an inner surface and an outer surface and at least one recess into which said wear element is received, and whereby said wear element is received by said recess with at least a portion thereof exposed to the inner surface of said rail, said at least one recess including a plurality of longitudinally extending substantially parallel grooves spaced and positioned across said hole and said wear element including a plurality of clongated steel reinforcing rods respectively received in said grooves.

3. A concrete forming panel comprising:

a face plate:

an elongated member secured to said face plate and constructed from a first material, said member having at least one longitudinally extending groove therein; and an elongated rod retained within said groove and extending longitudinally thereof, said rod being constructed from a second material having a hardness greater than that of said first material, said member having a hole extending transversely therethrough and presenting an inner circumscribing periphery, said rod extending transversely of said hole in tangential relationship with said periphery, said member having a surface through which said hole extends, said rod having a peripheral portion thereof projecting outwardly beyond said surface while a majority of the rod is recessed below said surface.

4. A concrete forming panel comprising:

a face plate;

an elongated member secured to said face plate and constructed from a first material, said member having at least one longitudinally extending groove therein; and an elongated rod retained within said groove and extending longitudinally thereof, said rod being constructed from a second material having a hardness greater than that of said first material, said member having a hole extending transversely therethrough and presenting an inner circumscribing periphery, said member having a pair of said grooves on opposite sides of said hole, each of said grooves containing a rod that extends transversely of the hole in tangential relationship with said periphery.

5. A concrete forming panel as claimed in claim 4, said hole having an axis, said grooves being offset from one another along the axis of the hole.

6. A concrete forming panel as claimed in claim 5, said member having a pair of oppositely facing surfaces through which said hole extends, one of said rods having a peripheral portion thereof projecting outwardly beyond a corresponding one of said surfaces while a majority of the one rod is recessed below said surface.

7. A concrete forming panel as claimed in claim 4, said member having at least one, longitudinally extending, hollow, internal chamber.

8. A concrete forming panel as claimed in claim 4, said member being devoid of hollow, internal chambers.

9. A concrete forming panel as claimed in claim 4, said first material being selected from the group consisting of aluminum and an alloy thereof, said second material being steel.

* * * * *